US006199912B1

(12) United States Patent
Finkelshteyn

(10) Patent No.: US 6,199,912 B1
(45) Date of Patent: Mar. 13, 2001

(54) GREETING CARD

(76) Inventor: Yan Finkelshteyn, 375 76 St. #5H, Brooklyn, NY (US) 11209

( * ) Notice: Subject to any disclaimer, the term of this patent is extended or adjusted under 35 U.S.C. 154(b) by 0 days.

(21) Appl. No.: 08/969,521

(22) Filed: Nov. 13, 1997

Related U.S. Application Data

(63) Continuation-in-part of application No. 08/549,389, filed on Oct. 27, 1995, now Pat. No. 5,687,992.

(51) Int. Cl.[7] ..... B42D 15/02; G09F 1/00; B65D 65/30; A63H 33/38

(52) U.S. Cl. ..... 283/117; 40/124.1; 446/149; 446/150; 428/15; 428/17; 428/22; 428/27

(58) Field of Search ..... 283/117; 40/124.1; 446/149, 150; 428/15, 17, 22, 27

(56) References Cited

U.S. PATENT DOCUMENTS

| | | | | |
|---|---|---|---|---|
| 4,774,780 | * | 10/1988 | Crowell | 446/149 |
| 5,022,681 | * | 6/1991 | Penick | 281/15.11 |
| 5,261,172 | * | 11/1993 | Rowley | 40/124.1 |
| 5,613,612 | * | 3/1997 | Davault | 206/768 |
| 5,658,620 | * | 8/1997 | Ross | 428/9 |
| 5,682,999 | * | 11/1997 | Larson | 206/768 |
| 5,687,992 | * | 11/1997 | Finkelshetyn | 283/117 |

* cited by examiner

*Primary Examiner*—A. L. Wellington
*Assistant Examiner*—Mark T. Henderson
(74) *Attorney, Agent, or Firm*—John D. Upham

(57) ABSTRACT

A simple foldable greeting card wherein, upon opening, decorative display elements self-generate a 3-D effect.

14 Claims, 2 Drawing Sheets

GREETING CARD

This application is a continuation in-part of my application Ser. No. 08/549,389 filed Oct. 27, 1995 now U.S. Pat. No. 5,687,992.

FIELD OF THE INVENTION

This invention relates to the field of greeting cards, and in particular greeting cards that provide a 3-dimensional (3-D) effect.

BACKGROUND

Greeting cards have become a ubiquitous feature of our society, and can be obtained celebrating every religious and secular or no event other than "Thinking of you" They range from the simplest of postcards to complex multi-layered structures giving a 3-dimensional (3-D) effect.

Yarnmunilert U.S. Design Patent 347,242 teaches a box-like structure within which a single artificial rose stem is mounted flat on the back of the box. A hole in the front allows the viewer a sight of the blossom, and opening the box gives a full view of blossom, foliage and stem. The only 3-D effect arises from the fact that the item displayed is itself 3-dimensional.

Sanford U.S. Pat. No. 3,798,806 provides a musical greeting card constituting a box held closed by interference fit, a music box within activated by opening the box, and a decorative flower stem resiliently supported on a tab integral with and extending angularly from a platform located on the inside of the box cover. When the box is closed, the tab carrying the flower stem decorative member is biased towards the platform, and when the box is opened the tab and decorative member spring away from the platform so as to pop up. Alternatively, the decorative member is resiliently supported on a compressed coil spring mounted on the platform.

Collins U.S. Pat. No. 4,879,823 shows a decorative display apparatus in which balloons are fastened to first ends of rods and the other ends of the rods are supported by a vertical display panel.

Penick U.S. Pat. No. 5,022,681 provides a pop-up device in which display elements are hinged to the inside surfaces of front and back covers. Opening the front cover causes erection of the display elements. Tabs limit the movement of the display elements so that they stand separated one from another.

BRIEF DESCRIPTION OF THE INVENTION

The present invention provides a simple foldable greeting card that in folded position is relatively flat and fits comfortably into an ordinary mailing envelope. Thus the basic card and envelope, both being made of paper or cardboard (that preferably is recycled and recyclable), are available at minimum cost.

On an inside surface, usually of the front of the card, is a decorative display, such as an artificial floral arrangement, made from materials chosen to have physical properties that cause the various portions of the display to provide of their own accord a self-generated pop-up 3-D structure when the card is opened. Thus the need for springs or other structures to create a pop-up effect is eliminated.

Decorative elements of the decorative display, for example foliage and/or blossoms of various kinds and colors, are made from paper, cloth, thin sheet or formed plastic, thin metal or the like, having a stiffness modulus and ductility sufficient to ensure the opening up of the display when card is opened, but not so great as to prevent flattening when the card is closed and such that the elements will maintain their positions though several cycles of opening and closing.

One embodiment of the invention provides as decorative elements one or more wires of small diameter anchored at one end (proximal) to the card and at the other end (distal) being free-floating and carrying a decorative item, such as a blossom. Again, a wire is chosen that has a stiffness modulus and ductility sufficient to ensure that upon opening the card the distal end springs out and is free floating forward of the card but not so great as to prevent flattening when the card is closed and such that the wires will maintain their positions though several cycles of opening and closing. The weight of the decorative item on the distal end naturally will affect the required stiffness modulus. The wire is ordinarily made of metal, such as copper, iron, steel, aluminum, etc., though extruded stiff but ductile plastic, or dried natural steams or reeds may also be used. It is preferred that the wire be readily bent into whatever shape the artist desires.

One skilled in the art, having been given the present disclosure, will readily choose by simple experiment whether a particular material or wire has the required stiffness as described herein. The materials chosen must also have sufficient ductility that they do not break upon just a few flexures.

While the decorative display is the principal feature of the invention, other surfaces of the card, both inside and outside, will normally carry the greeting message and other verbal and graphic matters.

The decorative displays of this invention comprise one or more decorative elements that pop up to form a self-generated 3-D structure. Particularly attractive are displays comprising multiple such decorative elements, wherein each independently has sufficient stiffness modulus to move of its own accord, whereby the multiple elements together provide a cumulative 3-D structure.

Multiple elements afford the designer great freedom in the placements and arrangement of the various aspects of the overall display. Elements can be present in as large an area of the card as may be desired. A multi-layer open 3-D structure can be created by arranging at least one of the decorative elements to stand farther forward of the face of the card than others and displaced laterally and/or vertically from others, enhancing the visibility of elements closer to the card. At least one of said other elements can be, for example, longer and narrower than the farther forward element(s).

DETAILED DESCRIPTION

Figure 1:
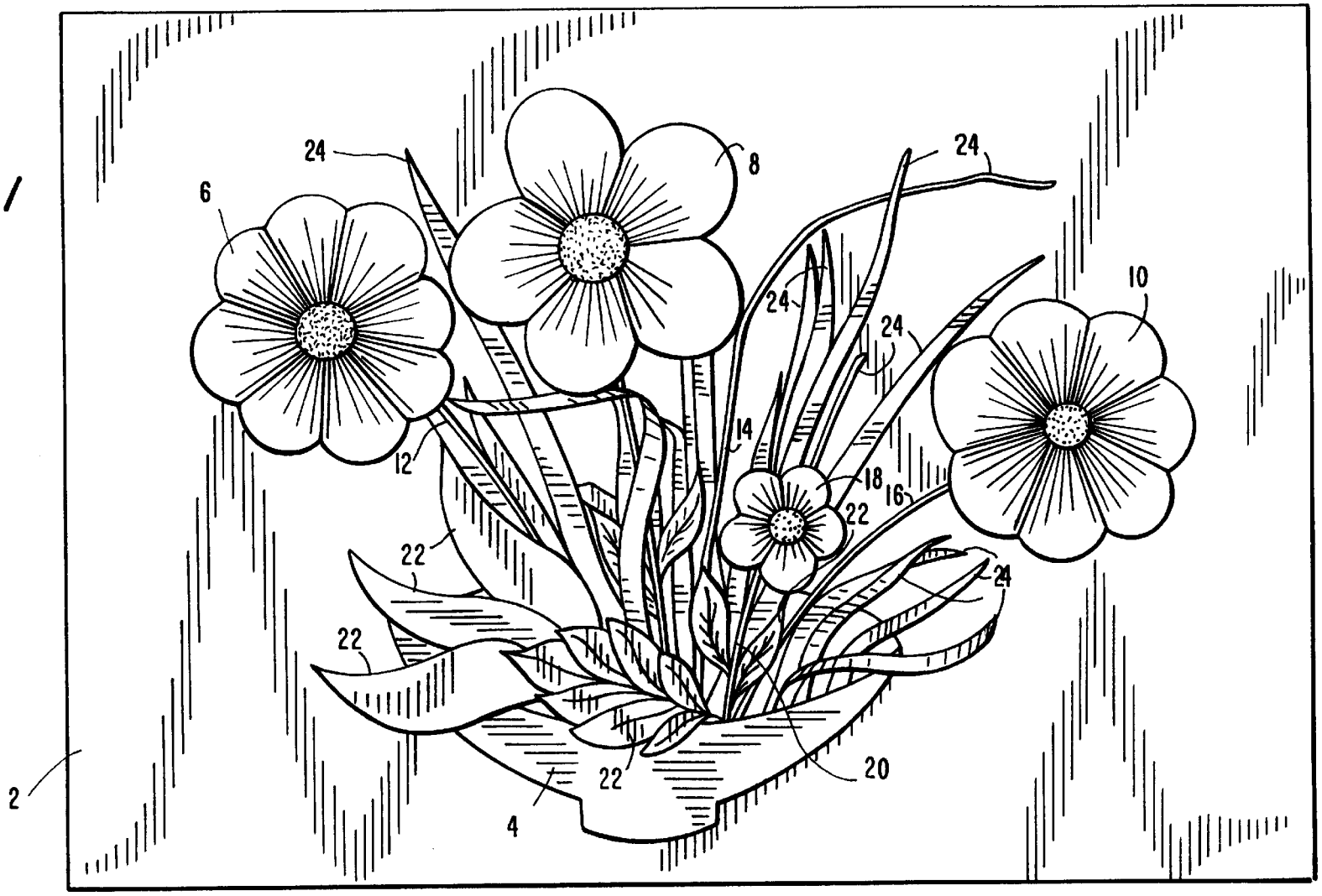
FIG. 1 shows the inner surface of the front portion of a card with floral display in accordance one embodiment of this invention. The card is folded (not shown) at the bottom edge of FIG. 1.
Figure 2:
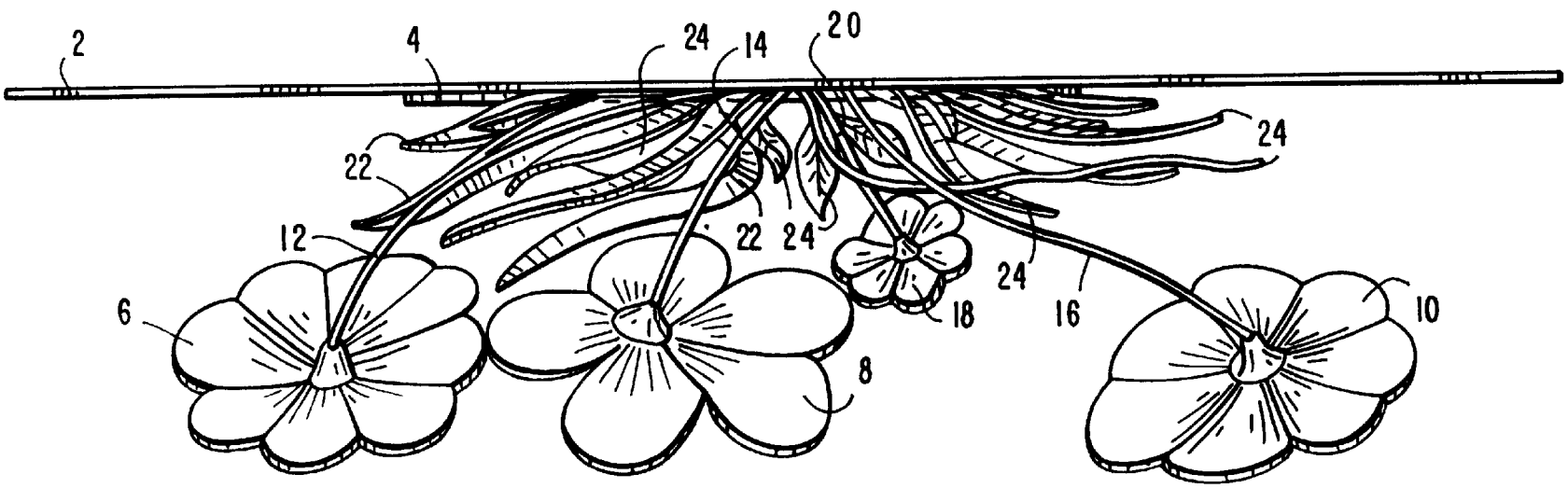
FIG. 2 is a view of the display of FIG. 1 when the card is in open position, looking straight at the top of the display.

In the two figures, i.e. in both FIG. 1 and FIG. 2, the same reference numerals are applied to the same element.

The card on which the display is mounted is designated by numeral 2. A vase 4 may be printed or painted on the card. In the embodiment shown here, it is made of paper or cloth adhered to a cardboard piece of the same shape which is fastened to the card with paste, glue, or pressure-sensitive adhesive.

Large blossoms 6, 8, and 10 are supported at the distal end of, respectively . wires 12, 14, 16. A smaller blossom 18 is fastened to the distal end of wire 20. The small blossom 18 alternatively may be adhered to some of the background foliage. The proximal ends of the wires are held by insertion between the vase and card, though any other means of attachment may be chosen. Flexibility of the wires and their ability to hold any shape give the card designer freedom to arrange, much as one would arrange live flowers in a vase. The recipient of the card will also find it pleasing to re-arrange the stems and/or blossom from time to time.

As can be observed in FIG. 2, the blossoms are free-floating forward of the face of the card and here are free-floating forward of the background foliage. When the card is closed, the blossoms and their supporting wires flatten; but when the card is opened, they spring forward again.

Turning now to what could be called in this case a decorative display or base of background foliage, broad leaf foliage 22 is set in front of narrower and taller foliage 24. The broadleafs are made of stiff cloth, the ones at the left being light green. The shorter, broader ones at front center are darker shades of green, and have veins imprinted on them. The narrow leafs foliage is also of various shades of green, and are made of stiff cloth, paper, plastic and/or natural vegetation.

Contrary to the wire stem of the flowers, the foliage pieces are generally of fixed shapes and placed in fixed positions in the overall decorative display. They lie close to and generally parallel to the card but extend at an acute angle thereto when the card is opened and are compressed flat when the card is closed. Their stiffness modulis meet the criteria set forth above.

As pointed our earlier, the present invention provides a simple foldable greeting card that is relatively flat and fits comfortable into an ordinary mailing envelope. One can start, before incorporating the decorative display, with a light cardboard card folded in half along a single line so that its inner surfaces are in contact with each other. It is generally preferred that the decorative display be such that the inner surfaces of the folded card containing the display are not more than about one-quarter of an inch apart. This facilitates use of simple commercially available envelopes. Ordinarily when the card is in open position, the free ends of the decorative elements extend not more than about an inch from the inner surface of the card that carries the decorative display, though this of course will depend upon the nature and extent of the self-generated pop-up action provided.

While the invention has been illustrated as a floral display, it may be utilized in countless other ways. For example, the decorative item on the distal end of a wire can be, e.g., a bird or other animal, a star, moon, balloon, musical note, or can be items being advertised or offered for sale, e.g. shoes, automobiles. As another example, the decorative base display can be a miniature town or house or playground, and items on the distal ends of wires can be dolls and/or other toys. The decorative display can be a landscape of mountains, trees, etc. Of particular interest are three-dimensional objects, for example, birds, shoes, on the free-floating ends of wires so that one can see the shape and view them from various angles; this is also possible to a lesser extent if they are anchored to the surface of the cards.

I claim:

1. A foldable card having on an inner surface thereof a decorative display readily compressed to a flattened position, said display comprising at least one elongated decorative elements which are visual parts of said display and which lie compressed flat when the card is in closed position, said elements having sufficient stiffness modulus to move of their own accord, when the card is opened, to positions at acute angles to the card thus providing a self-generated pop-up 3-D structure, the stiffness modulus and ductility of said decorative elements being such as to maintain the positions of said elements through several cycles of opening and closing.

2. A card according to claim 1, wherein the card when folded without the decorative display has its inner surfaces in contact with each other.

3. A card according to claim 1, wherein multiple decorative elements each independently has sufficient stiffness modulus to move of its own accord, said multiple elements together providing a cumulative 3-D structure.

4. A card according to claim 1, wherein when said card is in opened position at least one of the decorative elements stands farther forward of the supporting inner surface of the card than others and is displaced laterally or vertically from others thus creating a multi-layer 3-D structure.

5. A card according to claim 3, wherein said decorative elements comprise foliage or flowers and the opened card presents a 3-dimensional floral arrangement.

6. A card according to claim 4, wherein some of said foliage is broadleaf and some is longer and narrower leaf set behind the broadleaf.

7. A card according to claim 4, wherein a portion of said decorative display is in the shape of a vase.

8. A card according to claim 4, wherein at least one of said other elements is longer and narrower than said farther forward element.

9. A card according to claim 4, wherein said at least one of the decorative elements is displaced both laterally and vertically from others thus creating a multi-layer 3-D structure.

10. A process of displaying decorative elements, which comprises:

a) providing a foldable card which when folded has its inner surfaces in contact with each other;

b) attaching to an inner surface of said card a decorative display;

c) providing as part or all of said display at least one elongated decorative elements which are visual parts of said display and which lie compressed flat when the card is in closed position and having sufficient stiffness modulus to move of their own accord, when the card is opened, to positions at acute angles to the card thus providing a self-generated pop-up 3-D structure, the stiffness modulus and ductility of said decorative elements being such as to maintain the positions of said elements through several cycles of opening and closing.

11. A process according to claim 10, comprising providing multiple decorative elements each independently having sufficient stiffness modulus to move on its own accord, whereby said multiple elements together provide a cumulative 3-D structure.

12. A process according to claim 10, comprising arranging at least one of the decorative elements to stand farther forward of the supporting inner surface of the card than others and to be displaced laterally or vertically from others thus creating a multi-layer 3-D structure.

13. A process according to claim 11, wherein said decorative elements comprise foliage or flowers and the opened card presents a three-dimensional floral arrangement.

14. A card according to claim 12, wherein said at least one of the decorative elements is displaced both laterally and vertically from others thus creating a multi-layer 3-D structure.

* * * * *